US007120967B2

(12) United States Patent
Johnson

(10) Patent No.: US 7,120,967 B2
(45) Date of Patent: Oct. 17, 2006

(54) PET DOOR HINGE

(75) Inventor: Ryan E. Johnson, Dawsonville, GA (US)

(73) Assignee: Radio Systems Corporation, Knoxville, TN (US)

( * ) Notice: Subject to any disclaimer, the term of this patent is extended or adjusted under 35 U.S.C. 154(b) by 89 days.

(21) Appl. No.: 10/883,054

(22) Filed: Jul. 1, 2004

(65) Prior Publication Data

US 2006/0000059 A1 Jan. 5, 2006

(51) Int. Cl.
*E05D 11/04* (2006.01)
*E05D 11/08* (2006.01)

(52) U.S. Cl. ..... 16/275; 16/342; 16/50; 16/54

(58) Field of Classification Search ..... 16/275, 16/342, 337, 50, 54, 335; 49/168, 169, 170, 49/171, 386; 160/180, 380; 119/484
See application file for complete search history.

(56) References Cited

U.S. PATENT DOCUMENTS

| | | | | |
|---|---|---|---|---|
| 351,936 | A * | 11/1886 | Pfingst | 16/342 |
| 2,614,896 | A * | 10/1952 | Pierce | 384/99 |
| 3,387,505 | A * | 6/1968 | Rumsey | 74/574.4 |
| 3,436,069 | A * | 4/1969 | Henschen | 267/279 |
| 3,666,301 | A * | 5/1972 | Jorn | 403/228 |
| 3,978,616 | A | 9/1976 | Pennock | |
| 4,408,416 | A | 10/1983 | Davlantes | |
| 4,574,423 | A * | 3/1986 | Ito et al. | 16/85 |
| 4,776,133 | A | 10/1988 | Green | |
| 4,930,184 | A * | 6/1990 | Kristmanson | 16/273 |
| 5,419,013 | A * | 5/1995 | Hsiao | 16/319 |
| 5,581,940 | A | 12/1996 | Peterson | |
| 6,385,909 | B1 | 5/2002 | Marsh et al. | |
| 6,510,588 | B1 * | 1/2003 | Eromaki | 16/308 |
| 2002/0112319 | A1 * | 8/2002 | Kida | 16/342 |
| 2002/0121002 | A1 * | 9/2002 | Wu | 16/342 |

FOREIGN PATENT DOCUMENTS

| | | | |
|---|---|---|---|
| GB | 1451615 | A * | 10/1976 |
| WO | WO 3052230 | A1 * | 6/2003 |

* cited by examiner

*Primary Examiner*—Chuck Y. Mah
(74) *Attorney, Agent, or Firm*—Pitts & Brittian, PC

(57) ABSTRACT

A pet door hinge adapted to accommodate potentially damaging forces. The hinge mechanism includes a shaft that is received by a shock-absorbing bearing. The bearing is received by a sleeve. The bearing rotates within the sleeve to allow pivoting of the flap. In the event of potentially damaging forces, a resilient and deformable material forming the core of the bearing gives to prevent damage to or destruction of the hinge mechanism or the pet door.

12 Claims, 6 Drawing Sheets

PET DOOR HINGE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of Invention

The invention relates to a hinge for a pet door. More specifically, this invention relates to a flexible hinge adapted to resist damage or breakage resulting from undesirable forces applied to the hinge during the normal course of operation.

2. Description of the Related Art

Conventional pet doors have a movable flap residing within a frame. Soft flap pet doors take advantage of the flexibility of the flap to allow ingress and egress, such as that shown and described by Davlantes in U.S. Pat. No. 4,408,416. Hard flap pet doors must use a hinge mechanism to allow for movement of the flap. There are many basic hinge mechanisms commonly employed. One example of a common hinge mechanism is the molding of the shaft and the hinge tube as part of the flap and the frame, such as that shown and described by Green, in U.S. Pat. No. 4,776,133. Another example, is the use of a cam resting on a shelf, such as that shown and described in by Marsh, et al., in U.S. Pat. No. 6,385,909, or a cam resisted by a biasing member such as that shown and described by Pennock in U.S. Pat. No. 3,978,616. In yet another example, the flap and the frame may be connected by conventional hinges, such as that shown and described by Peterson in U.S. Pat. No. 5,581,940.

Each of the hard flap pet doors share the common concern of the hinge mechanism being subjected to potentially damaging forces, for example, the over-rotation of the flap. If the flap is pushed beyond the rotational limits afforded by the hinge mechanism, some portion of the rigid structure is forced to give. This can result in the breakage of the flap or the frame and/or the destruction of the hinge mechanism including but not limited the breakage of the shafts or the hinge tubes, the separation of the hinge from the flap or the frame, the breakage of the cam member, or merely the deformation of the hinge mechanism outside of tolerances resulting in unreliable performance. The same potential for damage often results from the physical construction of the pet door. When the hard flap rotates until it is contact with the top of the frame member, the pivot point is moved from the hinge mechanism to the point of contact between the frame and the flap. This results in lateral (i.e., non-rotational) forces, which a conventional hinge is not designed to accommodate, being applied to the hinge.

BRIEF SUMMARY OF THE INVENTION

A hinge for use in a pet door is shown and described. The hinge mechanism includes a shaft is received by a shock-absorbing bearing. The bearing is received by a sleeve. The bearing rotates within the sleeve to allow pivoting of the flap. In the event of undesirable forces being applied to the hinge mechanism, a deformable and resilient material forming the core of the bearing flexes to prevent damage to or destruction of the hinge mechanism or the pet door.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

A pet door hinge adapted to tolerate undesirable and potentially-damaging forces occurring within the normal course of operation of the pet door is shown in the figures and described herein. The general construction of a pet door is well known to those skilled in the art and, therefore, is not described in detail herein. Specifically, frames, flaps, closure mechanisms, locking mechanisms, and other common features are deemed to be within the purview of one of ordinary skill in the art. The pet door hinge described herein allows the movement of the flap and provides shock-absorption in the event that undesirable forces, such as lateral or excessive rotational forces, are applied to the hinge mechanism. It will be understood by those skilled in the art that the pet door hinge described herein can be used in various pet doors without departing from the scope and spirit of the present invention.

Figure 1:
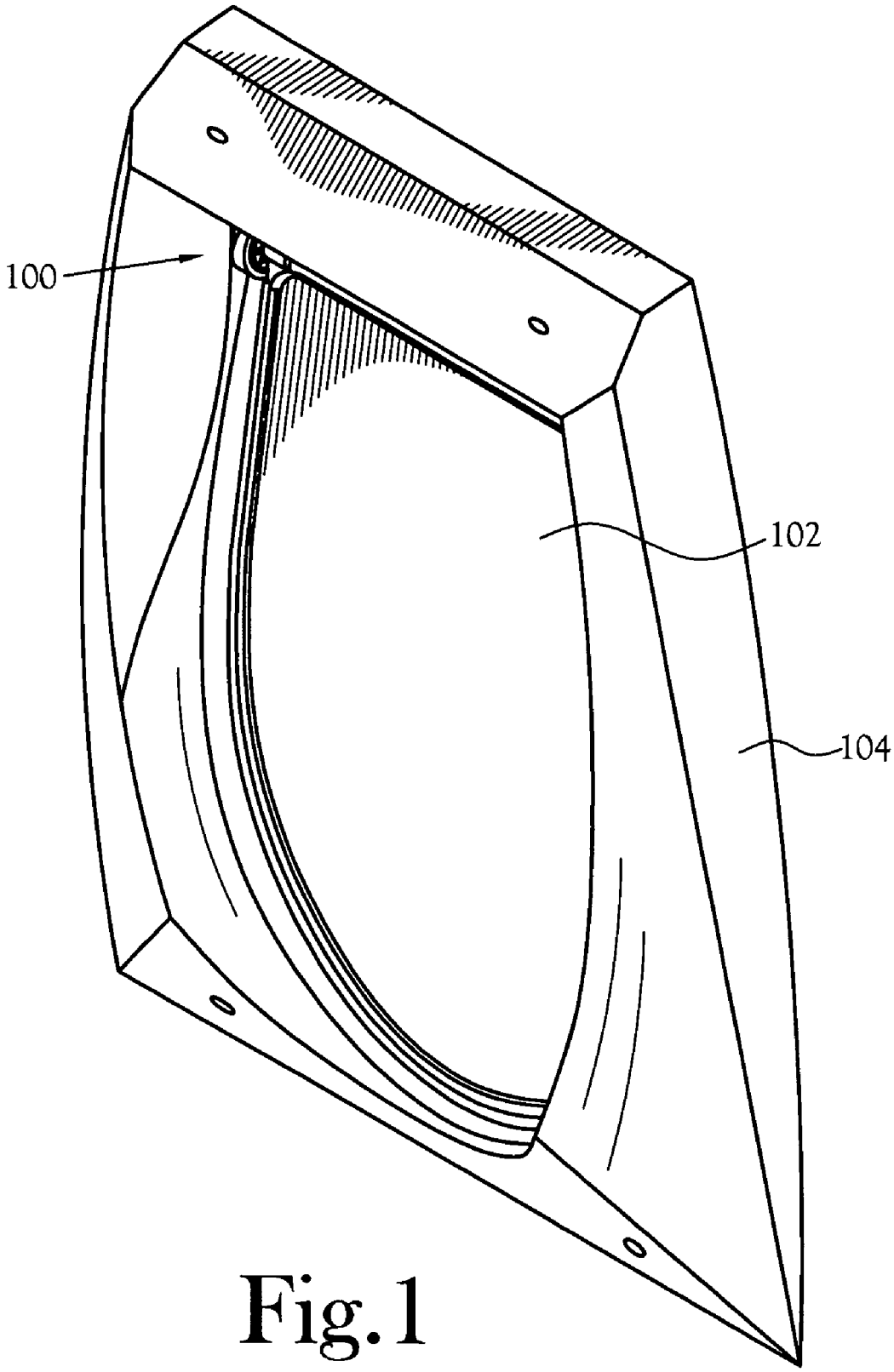
FIG. 1 illustrates a front perspective view of a pet door incorporating the hinge of the present invention.
Figure 2:
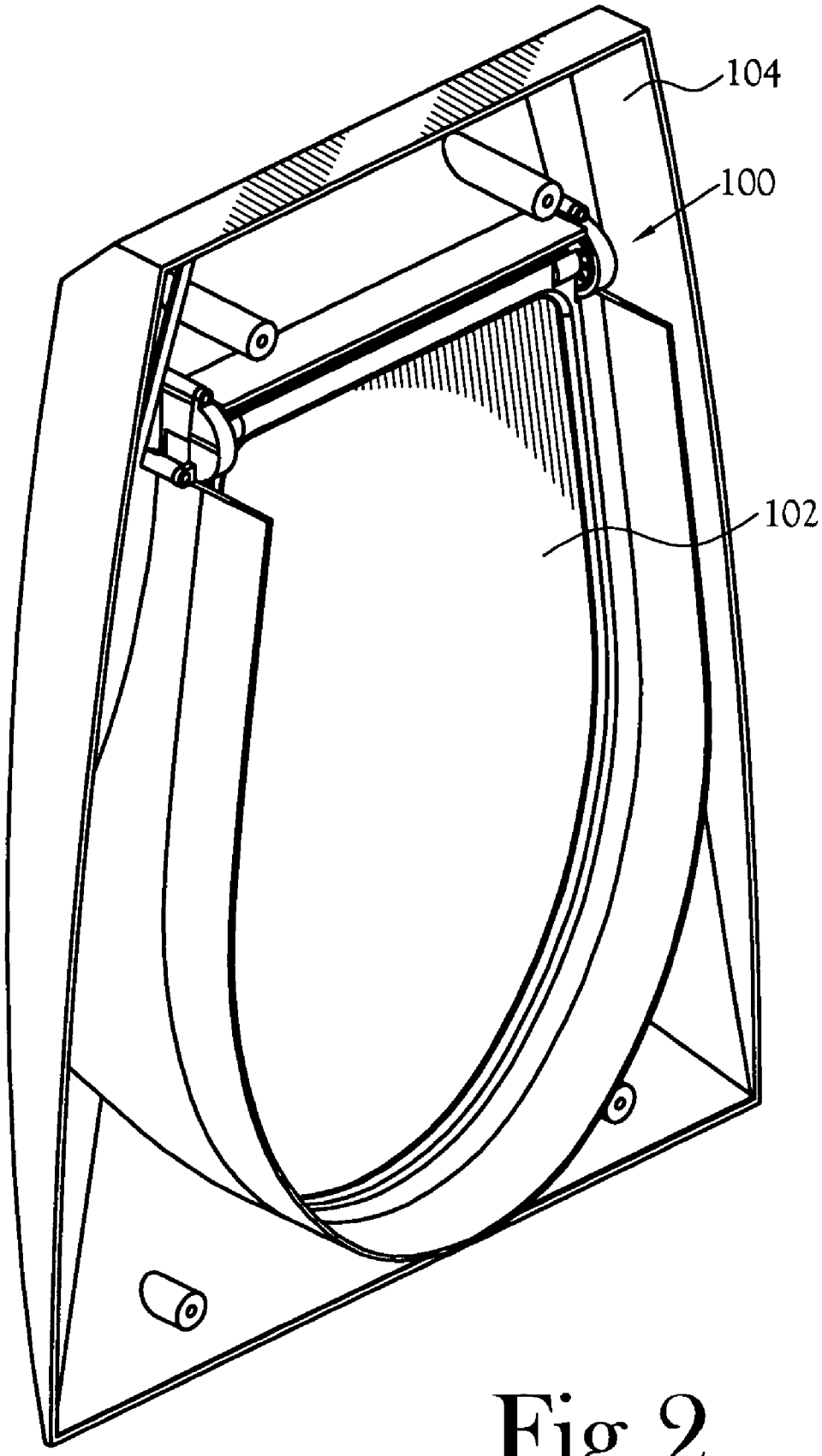
FIG. 2 illustrates a rear perspective view of a pet door incorporating the hinge of the present invention.

FIG. 1 illustrates a pet door incorporating one embodiment of a pet door hinge 100 of the present invention as viewed from the front. The pet door includes and a hard flap 102 located in a frame member 104. FIG. 2 illustrates the opposite side of the pet door of FIG. 1 once again showing the pet door hinge 100 of the present invention.

Figure 3:
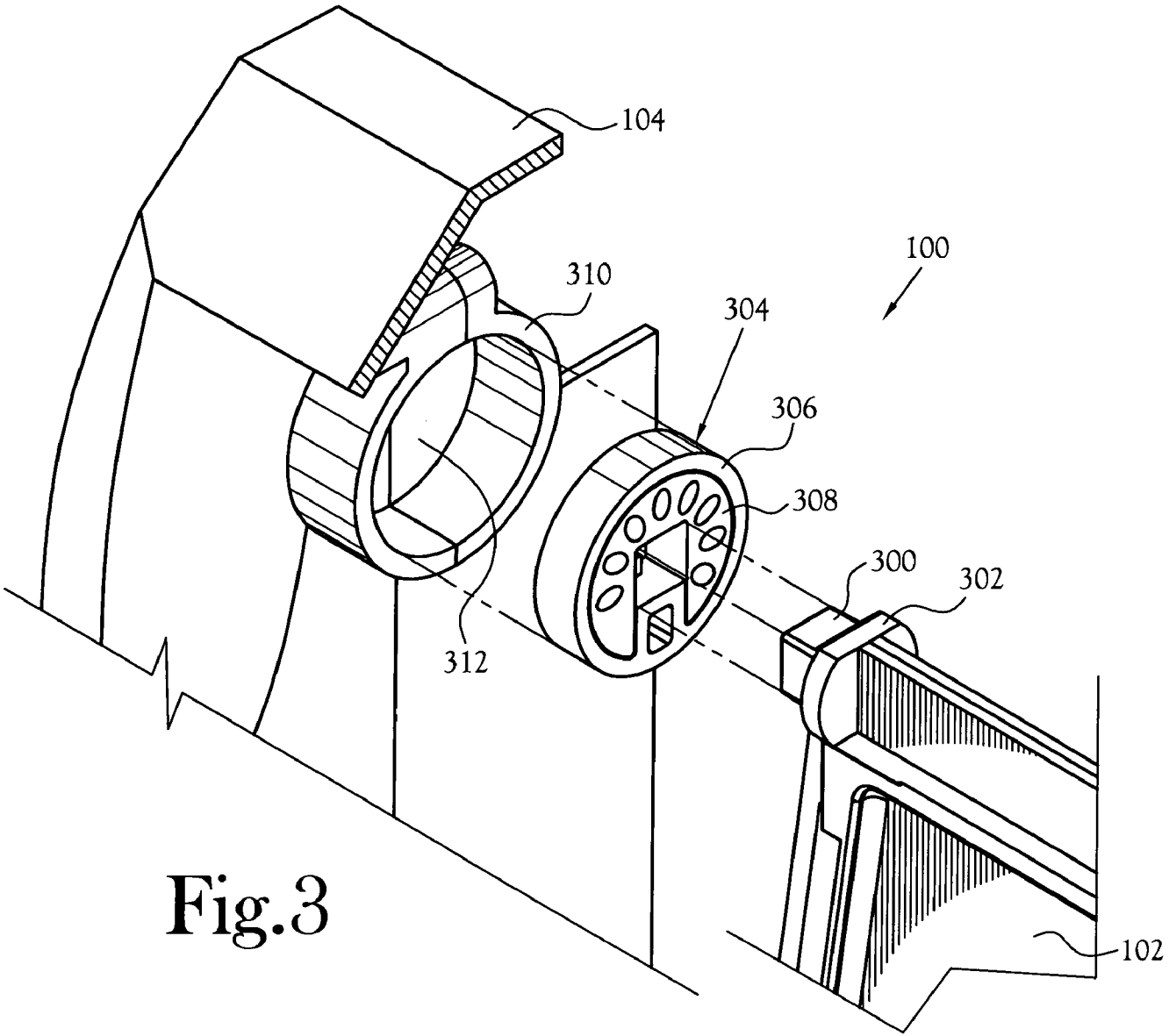
FIG. 3 illustrates an exploded view of the pet door hinge assembly, including the frame.

FIG. 3 illustrates an exploded view of the hinge 100. In the illustrated embodiment, the flap 102 has an integrally-molded shaft 300 with a substantially square cross-section backed by a substantially elliptical shoulder 302 and the frame member 104 includes a sleeve 310. A bearing 304 serves to mate the shaft 300 and the sleeve 310 to complete the hinge 100. The bearing 304 includes an outer ring 306 and a cushion 308. The outer ring 306 is adapted to be received within the sleeve 310. The bearing 304 rotates within the sleeve 310 to allow the flap 102 to pivot within the frame 104 and thereby allow ingress and egress through the pet door. The circular shapes of the bearing 304 and the sleeve 310 are generally conducive to smooth pivoting of the flap 102; however, friction reduction and the reduction of binding of the hinge 100 can be aided by the use of a lubricant, such as silicon oil, or fabrication of the hinge from a slf-lubricating materterial, such as Delrin® from E.I. du Pont de Nernours and Company (polyoxymethylene), nylon, polypropylene, a material coated with Teflon® (fluoropolymer), or a material impregnated with silicon. A lip or, as illustrated in FIG. 3, a wall 312 serves to limit the depth of the sleeve 310 with respect to the bearing 304 and hold the bearing 304 securely on the shaft 300 when the hinge 100 is assembled. Similarly, the shoulder 302 serves as a stop for the bearing 304 on the flap-side of the hinge 100.

The void defined by the outer ring 306 is substantially filled with a cushion 308 that is generally secured to the outer ring 306. The cushion 308 is fabricated from a polymeric material that is resilient and deformable, for example, rubber polyisoprene. In one embodiment, the cushion 308 defines a plurality of through-openings that provide room for the deformation of the cushion 308 in the event of the undesirable forces on the hinge 100. The shape, size, number, and position of the through-openings are selected to provide the desired amount of deformation. In an alternate embodiment, the material from which the cushion 308 is fabricated exhibits sufficient compressibility to provide the desired deformation without the use of through-openings. Those skilled in the art will recognize other materials which could be used without departing from the scope and spirit of the present invention including closed or open cell foam.

The cushion 308 defines an opening adapted to receive the shaft 300. The shaft 300 is generally shaped so as not to rotate within the cushion 308 opening in the presence of normal operating forces required to move the flap 102. Typically, any geometric shape having corners tends to resist rotation, for example the substantially square-shaped shaft illustrated in the FIGS. Although generally deformable, the cushion 308 is fabricated from a material that does not deform under the normal operating forces required to move the flap 102, i.e., while the bearing freely rotates. In the most basic embodiment, the engagement of the shaft 300 and the cushion 308 is in the fashion of a mortise-and-tenon. Other embodiments incorporate additional features such as those illustrated in the Figures.

Figure 4:
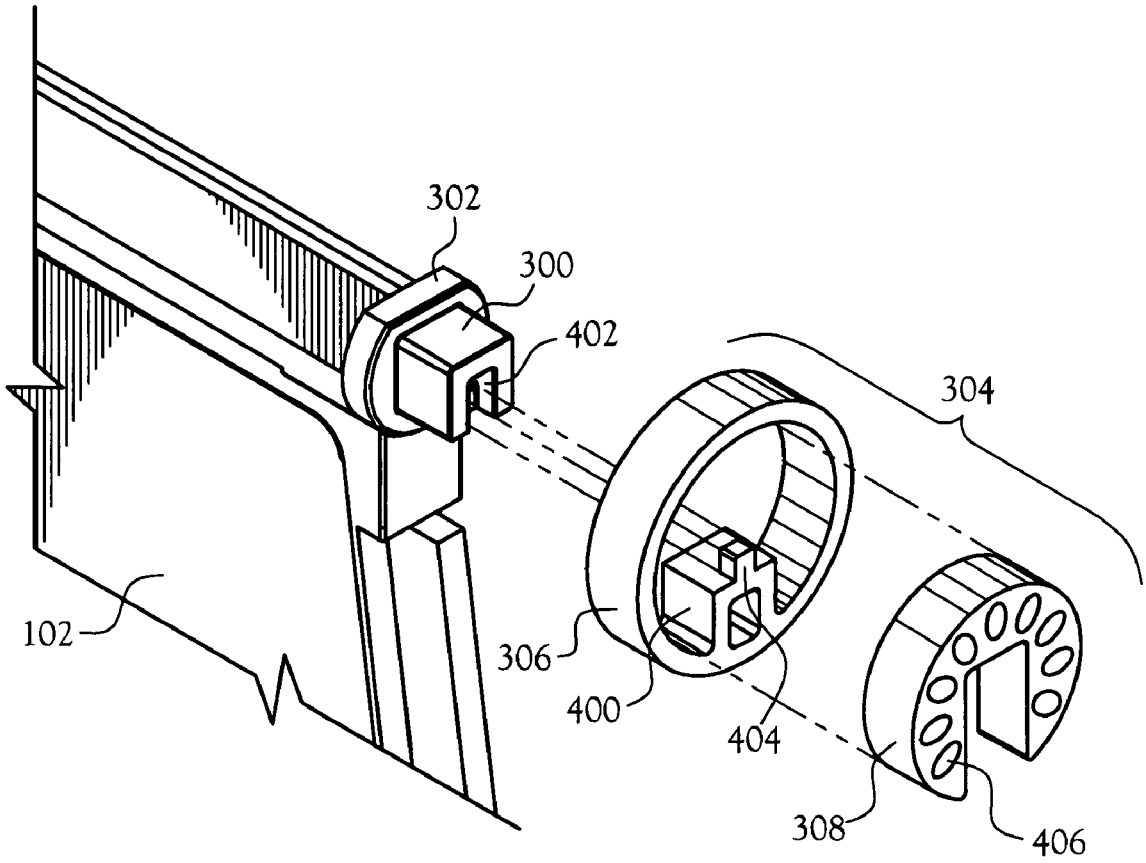
FIG. 4 illustrates an exploded view of the pet door hinge assembly.

FIG. 4 illustrates an exploded view of the hinge 100 from the opposite viewpoint of FIG. 3. The illustrated bearing 304 includes an inwardly-projecting extension 400 adapted to engage a surface of the shaft 300 and provide a non-deformable support for the shaft 300 to act against. Generally, the extension 400 is generally shaped and sized similarly to the shaft 300. When the extension 400 is employed, the extension 400 and the cushion 308 cooperate to substantially fill the void defined by the outer ring 306 and to secure the bearing 304 to the shaft 300. As illustrated, the extension 400 has approximately the same width as the shaft 300 and both the extension 400 and the shaft 300 have substantially equal heights, which are each approximately one-third of the internal diameter of the outer ring 306. The remainder of the internal area of the ring 306 not occupied by the extension 400 and the shaft 300 is occupied by the cushion 308. The dimensions are selected so that the shaft 300 is generally centered within the bearing 304. Those skilled in the art will recognize other dimensions and arrangements for centering the shaft 300 within the bearing 304 without departing from the scope and spirit of the present invention.

A further refinement visible in FIG. 4 is the addition of a keyway 402 in the shaft 300 and a corresponding key 404, which in the illustrated embodiment protrudes from the extension 400. The key 404 and keyway 402 serve to properly align the bearing 304 and the shaft 300 and to further insure that the shaft 300 and the bearing 304 rotate together. It will be recognized by those skilled in the art that the inwardly projecting extension 400 and the key 404 and keyway 402 are refinements to the basic hinge 100 described herein. Such refinement offers advantages over the basic embodiment but are not required to fall within the scope and spirit of the present invention.

Figure 5:
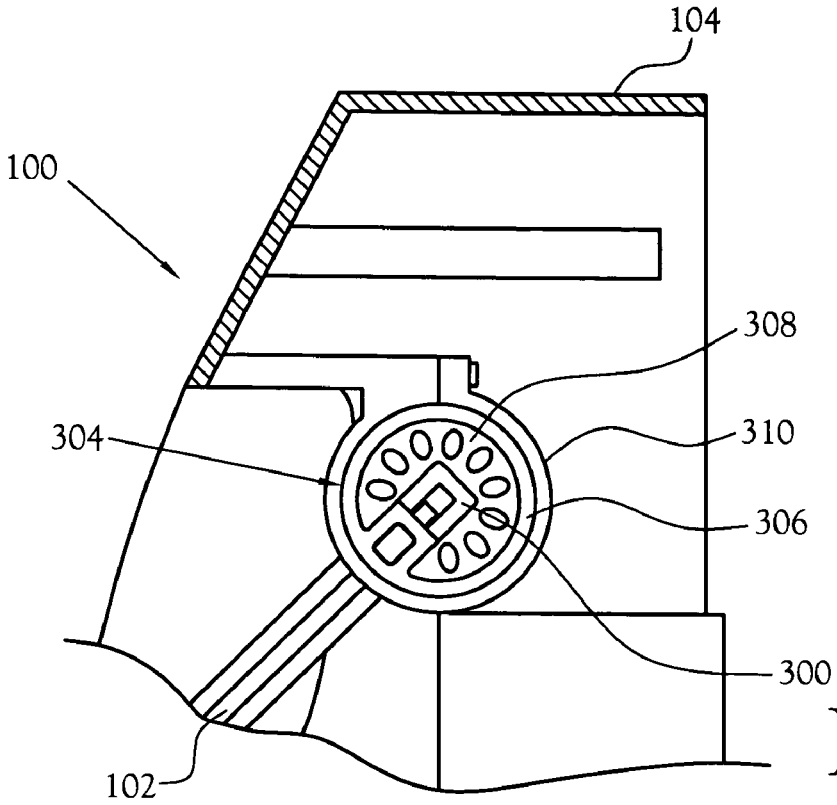
FIG. 5 illustrates the operation of the pet door hinge when the flap is rotated within the defined limits of movement.
Figure 6:
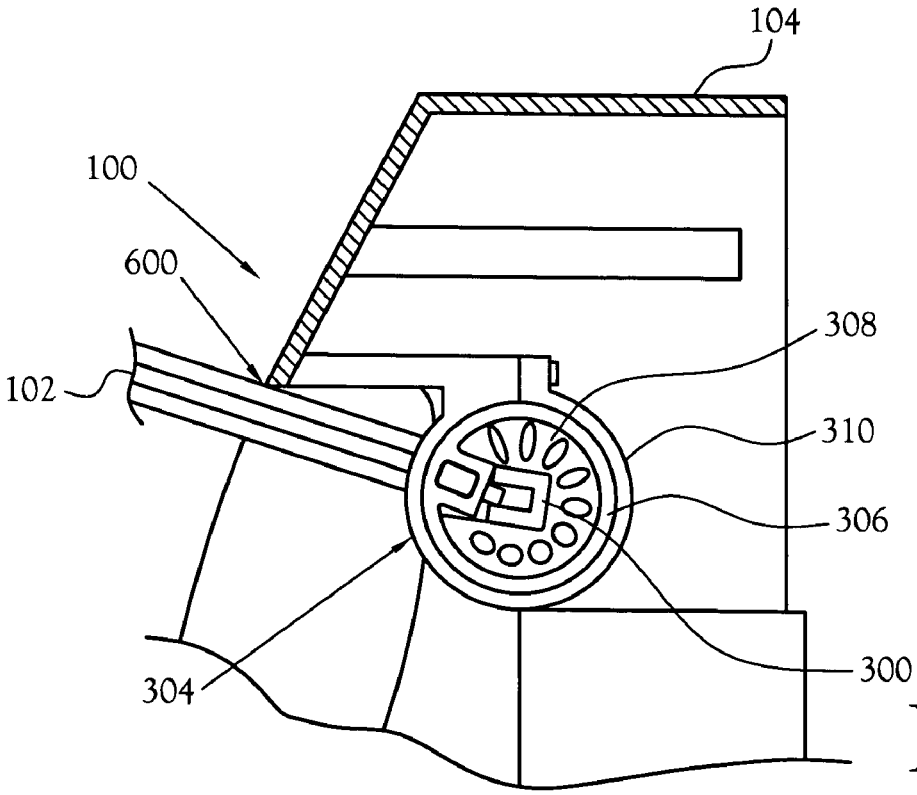
FIG. 6 illustrates the operation of the pet door hinge when the flap is rotated into engagement with the frame member.

FIG. 5 illustrates the rotation of the hinge 100 within the normal movement range of the flap 102. FIG. 6 illustrates the resilience of the hinge 100 when the hinge 100 is subjected to undesirable non-rotational forces. In the illustrated embodiment, the flap 106 is pushed into contact with the frame member 104, which moves the pivot point of the flap 102 from hinge 100 to the point of contact 600 between the flap 102 and the frame member 104. As the flap 102 is substantially rigid, further upward movement of the flap 102 when so engaged with the frame member 104 results in undesirable lateral forces being applied at the hinge 100. These lateral forces are not compatible with the rotational design of the hinge mechanism 100. Accordingly, the cushion 308 compresses to accommodate these undesirable forces. The deformation is represented by the flattening of some of the cushion through-openings and the acceptance of the cocked relationship between the shaft and the extension. In this manner, the hinge mechanism 100 resists breakage or other damage. When the undesirable forces cease, the resilient nature of the cushion 308 allows the bearing 304 and the shaft 300 to return to their normal relative positions.

Figure 7:
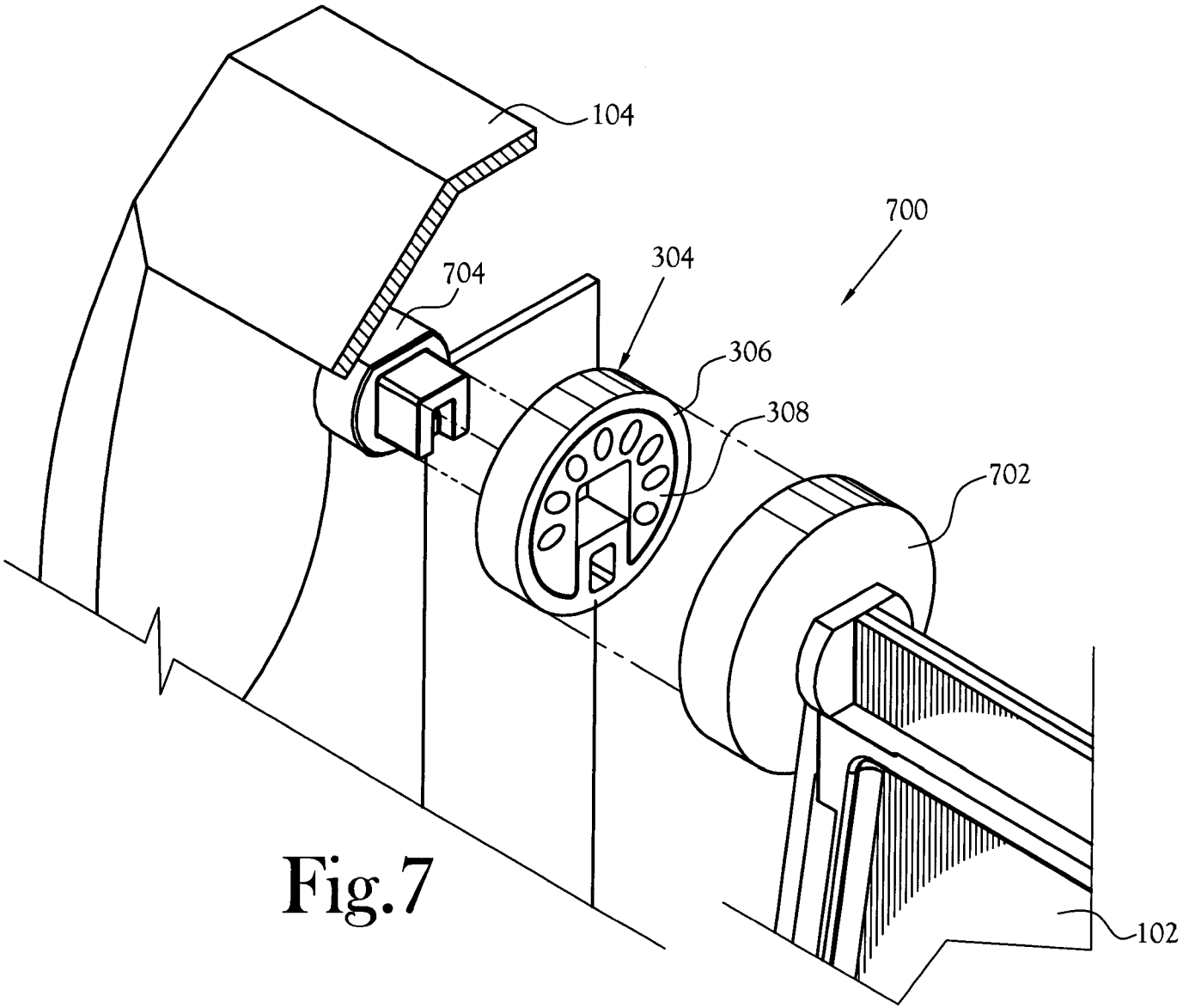
FIG. 7 illustrates an exploded view of an alternate embodiment of the pet door hinge assembly.

Herein, the shaft 300 has been shown and described as part of the door flap 102 and the sleeve 310 has been shown and described as part of the door frame 104. It will be understood by those skilled in the art that relative placement of the shaft 300 and the sleeve 310 can be reversed without departing from the scope and spirit of the present invention. FIG. 7 illustrates an alternate embodiment the hinge 700 where the sleeve 702 is incorporated into the flap 102 and the shaft 704 is incorporated into the frame 104. The bearing 304 remains carried by the shaft 704 and received by the sleeve 702. The reversed pet door hinge 700 operates identically to the other pet door hinge embodiment 100.

A pet door hinge adapted to tolerate undesirable and potentially damaging forces applied during normal operation of the pet door has been shown and described. The hinge mechanism incorporates a bearing have a core formed from a resilient, deformable polymeric material forming the core of the bearing. The core gives under pressure in order to prevent damage to or destruction of the hinge mechanism or the pet door. Those skilled in the art will recognize the geometric shapes and relative dimensions described herein are exemplary and represent easily moldable parts. Other shapes and dimensions could be used without departing from the scope and spirit of the present invention.

While the present invention has been illustrated by description of several embodiments and while the illustrative embodiments have been described in detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

I claim:

1. A pet door hinge assembly comprising:

a shaft extending from a first piece of a pet door having a frame and a flap, said first piece being one of said frame and said flap;

an opening defined by a second piece of said pet door, said second piece being the other of said frame and said flap; and a bearing including a ring and a cushion, said cushion filling a portion of a void defined by said ring, said cushion being resilient and deformable, said bearing defining an opening for receiving said shaft in a substantially non-rotating engagement, said bearing being received by said second piece opening, said bearing rotating within said second piece opening.

2. The pet door hinge assembly of claim 1 wherein said ring is fabricated from a self-lubricating material.

3. The pet door hinge assembly of claim 1 wherein said ring is fabricated from the group consisting of nylon, polypropylene, polyoxymethylene, and a material coated with a fluoropolymer.

4. The pet door hinge assembly of claim 1 wherein said cushion defines at least one void to allow for deformation of said cushion.

5. The pet door hinge assembly of claim 1 wherein said cushion is fabricated from the group consisting of a thermoplastic elastomer and polyisoprene.

6. The hinge assembly of claim 1 wherein said ring includes a shoulder, said shoulder occupying a portion of said void not occupied by said cushion, said shoulder engaging a portion of said shaft, said shaft and said shoulder being keyed to substantially prevent said shaft from rotating independently from said bearing.

7. A pet door comprising:

a frame for bounding an opening providing ingress and egress to an animal;

a flap substantially filling said opening, said flap being substantially rigid; and a hinge linking said frame and said flap, said hinge allowing said flap to pivot within said frame opening, said hinge comprising a bearing and a shaft, said bearing comprising a ring defining a void and a cushion filling a portion of said void, said cushion being both resilient and deformable, said bearing receiving said shaft in a non-rotating engagement in said void, said bearing adapted to accommodate undesirable forces without resulting in damage to any of said frame, said flap, and said hinge.

8. The pet door of claim 7 wherein said hinge further comprises a sleeve receiving said bearing in a rotating engagement.

9. The pet door of claim 7 wherein said ring includes an extension adapted to engage a portion of said shaft.

10. A pet door comprising:

means for framing an opening;

means for blocking an opening defined by said means for framing;

means for pivoting said means for blocking an opening to allow ingress and egress through said pet door; and means for cushioning said means for pivoting to prevent damage to said pet door when said means for blocking an opening is moved beyond a maximum limit.

11. A pet door hinge assembly comprising:

a pet door having a first part and a second part, said first part being one of a pet door frame and a pet door flap and said second part being the other of the pet door frame and the pet door flap;

a bearing sleeve connected to said pet door first part;

a shaft extending from said pet door second part;

a bearing ring having an inwardly-projecting extension, said bearing ring and said inwardly-projecting extension cooperating to define a void, said bearing ring being free to engage in rotational movement within said bearing sleeve, and a bearing cushion disposed within said void, said bearing cushion being fabricated from a resilient and deformable material, said bearing cushion and said inwardly-projecting extension cooperating to define a shaft opening adapted to receive said shaft, said bearing cushion and said inwardly-projecting extension operatively engaging said shaft when said shaft is inserted into said shaft opening, said bearing cushion and said inwardly-projecting extension transferring the rotational movement to said shaft.

12. A pet door comprising:

a frame for bounding an opening providing ingress and egress to an animal;

a flap substantially filling said opening, said flap being substantially rigid; and a hinge linking said frame and said flap, said hinge allowing said flap to pivot within said frame opening, said hinge comprising a shaft, a bearing, and a sleeve, said bearing independent of said frame and said flap, said shaft received by said bearing, said bearing received within said sleeve, said bearing including a cushion adapted to accommodate undesirable forces without resulting in damage to any of said frame, said flap, and said hinge.

* * * * *